US008841990B2

(12) United States Patent
Bell

(10) Patent No.: US 8,841,990 B2
(45) Date of Patent: Sep. 23, 2014

(54) SYSTEM FOR TRANSMITTING EMERGENCY BROADCAST MESSAGES WITH SELECTIVITY TO RADIO, TELEVISION, COMPUTERS AND SMART PHONES

(76) Inventor: Franklin W. Bell, Clifton, NJ (US)

( * ) Notice: Subject to any disclaimer, the term of this patent is extended or adjusted under 35 U.S.C. 154(b) by 73 days.

(21) Appl. No.: 13/506,692

(22) Filed: May 10, 2012

(65) Prior Publication Data

US 2013/0300536 A1 Nov. 14, 2013

(51) Int. Cl.
*G08B 5/22* (2006.01)

(52) U.S. Cl.
USPC ..... 340/7.45; 455/3.01; 455/13.1

(58) Field of Classification Search
USPC ..... 340/539.16, 7.45; 380/258; 725/24, 46; 709/240; 370/359.64; 455/3.01, 13.1
See application file for complete search history.

(56) References Cited

U.S. PATENT DOCUMENTS

| | | | | |
|---|---|---|---|---|
| 4,371,871 | A * | 2/1983 | Adams | 709/240 |
| 4,633,515 | A | 12/1986 | Uber et al. | 455/161.3 |
| 4,956,875 | A | 9/1990 | Bernard et al. | 455/13.1 |
| 5,095,532 | A | 3/1992 | Mardus | 455/186.1 |
| 5,121,430 | A * | 6/1992 | Ganzer et al. | 380/258 |
| 5,181,208 | A | 1/1993 | Duckeck | 714/776 |
| 5,276,909 | A | 1/1994 | Milner et al. | 340/7.49 |
| 5,880,720 | A * | 3/1999 | Iwafune et al. | 725/24 |
| 6,204,761 | B1 | 3/2001 | Vanderable | 340/539.28 |
| 7,100,183 | B2 | 8/2006 | Kunkel et al. | 725/34 |
| 7,228,555 | B2 | 6/2007 | Schlack | 725/35 |
| 7,444,657 | B2 | 10/2008 | Kendall et al. | 725/33 |
| 7,592,912 | B2 * | 9/2009 | Hasek et al. | 340/539.16 |
| 7,646,774 | B2 * | 1/2010 | Kim et al. | 370/395.64 |
| 7,665,106 | B2 | 2/2010 | Kim et al. | 725/33 |
| 2002/0056107 | A1 * | 5/2002 | Schlack | 725/46 |
| 2006/0242652 | A1 | 10/2006 | Stearn | 719/318 |
| 2008/0085695 | A1 | 4/2008 | Vare et al. | 455/404.1 |
| 2009/0291630 | A1 * | 11/2009 | Dunn et al. | 455/3.01 |

* cited by examiner

*Primary Examiner* — Steven Lim
*Assistant Examiner* — Kaleria Knox
(74) *Attorney, Agent, or Firm* — Ernest D. Buff & Assoc. LLC; Ernest D. Buff

(57) ABSTRACT

A system digitally retransmits an emergency alert message to a plurality of recipients. A specialized category of recipients, which function to combat an emergency, receive specialized instructions to coordinate and handle an emergency situation. The digitally retransmitted emergency alert message includes a specialized unique code for each of the specialized category of recipients, along with specialized instructions along with an uncoded generic public or private emergency alert message. Each of the receivers of specialized category of recipients decodes the message pertinent to that recipient upon receipt of a matching specialized code programmed within the receiver. The generic uncoded public emergency message is received by all generic devices without specialized codes. The emergency alert message is devoid of additional information which, when present, could be burdensome. This implementation is optimized to provide very rapid alerts for specific message types e.g. earthquakes.

14 Claims, 9 Drawing Sheets

SYSTEM FOR TRANSMITTING EMERGENCY BROADCAST MESSAGES WITH SELECTIVITY TO RADIO, TELEVISION, COMPUTERS AND SMART PHONES

BACKGROUND OF THE INVENTION

1. Field of the Invention

The present invention relates to systems for transmitting emergency broadcast messages; and more particularly to a system for transmitting instructions to a plurality of user devices including television, radio, computers and smart phones wherein the message content is modified on a need to know basis for each of the receiving devices.

2. Description of the Prior Art

There presently exist various methods for delivering emergency broadcast messages. Broadcast of emergency messages in TVs includes a bright band with floating text that displays the alert message while the message broadcast through radio includes a characteristic beep followed by the emergency broadcast. In the case of television emergency messages, a current implementation provides a display of text of the emergency message on the screen. This display commonly is a red horizontal background band with white text inserted. While it is not currently implemented to replace this band with a normal picture, it is less intrusive than the alert message audio replacing the program audio. The technology described herein provides features that enable the individual receivers to be able to insert required data which may be a text band, TV broadcast or computer message that is handled internally within the electronics of the receiver. This allows the device to perform needed emergency functions in a timely manner. One method, reportedly used in Japan to deliver earthquake alerts, is to use a dedicated radio broadcast network. This radio broadcast network is operated by the Japanese Meteorological Office, which is responsible for disaster alerts. Japanese consumer receivers are reportedly required to include a tuner to receive these alerts, and to turn on and present the message. This method is more expensive for the consumer electronics, and also requires another dedicated radio network expense. In the case of police or first responder systems, a special digital communication system is used between the police station or Emergency Management and mobile units using specialized dedicated communication means. None of these technologies communicate with a plurality of dedicated receivers used by special personnel that receive specialized instructions according to the needs of the user.

U.S. Pat. No. 4,633,515 to Uber, et al. discloses an emergency broadcast alert detector. This emergency broadcast alert detector has a radio receiver scanning among several predetermined frequencies. The audio output of the radio receiver is connected to a noise detector that allows scanning to continue as long as noise indicative of no signal being received is present on the audio output. When the radio receiver scans to a frequency on which a broadcast is present, the lack of noise on the audio output of the receiver causes scanning to discontinue. The audio output is also connected to a tone detector that generates an alarm for a predetermined period in the event that an alert tone of a predetermined frequency is present on the audio output of the radio receiver. This detector scans several frequencies and detects and locks in on an emergency broadcast alert signal broadcast, and alerts the user. The '515 patented device is clearly a receiver that scans a plurality of frequencies and locks in on an alert channel when a transmitted signal is present, at which time the usual channel noise is absent. This '515 patented receiver does not function as an emergency broadcast signal transmitter that provides emergency alerts to a plurality of user devices according to user needs.

U.S. Pat. No. 4,956,875 to Bernard, et al. discloses an emergency radio alerting and message transmitting system directable to selected classes and numbers of receivers. This emergency radio alerting and warning system comprises an FM transmitter. It has a first and a second encoding means. The first encoding means enables the selection of all receivers in a given location, and the second encoder enables broadcasting to be made to particular receivers in the selected location. The transmitter broadcasts signals with the encoded signals, which are followed by signals that sound audible alarms at the receivers so encoded, and then broadcast the messages over loudspeakers at the selected receivers. The FM receivers are receptive but inactive until an encoded signal specific to that receiver is received. This fully activates the receiver to sound an audible alarm to alert persons in the vicinity, and initiates the message broadcast. Timing means are present to terminate any message to the receiver after a given period unless extended by repetition of the coded signal by the transmitter. The emergency FM broadcast is encoded in first and second encoding means and can only be received by FM receivers. However, the '875 patent's solution requires the implementation of one more communications system in addition to those used for FM broadcast media, so that the local police, fire and hospital or ambulance personnel can radio, telephone or otherwise inform the local station about local emergencies such as fires, wrecks and floods. The need for this additional communication system would require end users to buy new equipment that is compatible with the system. Legacy user devices would not be compatible with the system and would not receive emergency messages. Additionally, the system is not designed to work in conjunction with current EAS systems. The emergency broadcast is not received by a plurality of user devices and is not broadcast according to user needs.

U.S. Pat. No. 5,095,532 to Mardus discloses a method and apparatus for route-selective reproduction of broadcast traffic announcements. In this method for route-selective reproduction of digitally encoded traffic announcements broadcast by a transmitter to a vehicle receiver includes the decoding of announcements, a comparison of route-specific characteristics with characteristics of the trip route. If the characteristics agree to a predetermined extent, the driver is provided with the traffic announcement applicable to him, via a visual and/or acoustical output device. In a feature of this method, the road types and their numerical designations are used as the route-specific characteristics. In a further feature of this provision, major route segments and shorter route segments may also serve as route-specific characteristics. By means of a trip segment transducer, the distance already covered can also be ascertained, so that only traffic announcements pertaining to obstructions in regions of the route that are still to be covered are transmitted. By additionally evaluating the driving speed, traffic announcements pertaining to very distant obstructions that can be expected to have been eliminated by the time that segment is reached can also be suppressed. The advantage of these provisions is that the driver is not distracted by a great number of traffic advisories that are not relevant for the driver. This is a traffic announcement system uses digitally encoded traffic announcement broadcast and extracts from the data segment specific information. This system is clearly a traffic alert receiver that registers and delivers traffic alerts according to detection of a trip segment providing relevant traffic information to the driver. This receiver does not function with an emergency broadcast signal transmitter that provides emergency alerts to a plurality of user devices according to user needs U.S. Pat. No. 5,121,430 to Ganzer, et al. discloses a storm alert for emergencies. A geographically specific emergency alert system includes a code generator unit in which geographic areas to be alerted and types of severity of alerts are selected and code strings generated to represent the affected areas and alert types selected. The code strings are broadcast by modulating the audio carrier of a television signal and received on receiver units positioned in areas within the broadcast market of a television station providing the alerting service. Location codes are entered into the receiver units by the users according to the areas in which the receiver units are used. When an alert is broadcast, each receiver unit decodes a location code string in the signal. If it matches that set on the receiver, an alert code string is decoded to activate an alarm device connected to the receiver, such as an audible alarm generator, LED, etc., in accordance with the type or severity of alert that was broadcast. For this system to work properly, the user has to set the receiver for the proper geographic code even though the alert issued is a public alert message. In the absence of this setting an emergency alert message will be missed. This system broadcasts storm alerts based on ZIP code of a geographic area to televisions for display and does not broadcast general emergency alerts to a plurality of user devices based on user needs.

U.S. Pat. No. 5,181,208 to Duckeck discloses a computation-conserving traffic data transmission method and apparatus. In this system, the traffic announcements are received in digitally encoded form in a data packet. The data packet is decoded continuously, and the traffic announcements are stored in memory after the decoding and evaluation. A computer in the receiver must evaluate the incoming data stream continuously. Since evaluation is difficult, particularly under unfavorable broadcasting conditions in which error corrections may be necessary, the computer would have to have a very complex program structure and configuration. To make it possible to use a simpler computer configuration and program structure, one complete cycle of traffic announcements is first decoded, optionally error corrected and stored in memory. Next, an updating bit present in the data packet and altered upon any change in the traffic announcements, is identified and evaluated. As a function of this evaluation, a further complete cycle of traffic announcements is decoded and stored in memory only if the updating bit has altered. This device is clearly a traffic message channel receiver of digital data packet and computes changes in the traffic message to communicate via audio to the driver. This system does not broadcast emergency alerts to a plurality of user devices based on user needs.

U.S. Pat. No. 5,276,909 to Milner, et al. discloses a traffic information broadcast system. This broadcast and reception system provides a segmented broadcast signal for providing regional traffic information and a receiver adapted to receive selected segments of that broadcast. The segmented broadcast signal includes a number of segments each of which includes a tone sequence, a digital regional code, a digital duration code, and an audio segment. The receiver monitors selected regional traffic segments and converts the selected audio segment to a form compatible with a standard automotive radio. Thus, a user can selectively monitor regional traffic information without having to listen to reports from regions of no interest to him. Alternatively, the selected traffic information can automatically override normal radio listening. This is a traffic alert broadcast system and the receiver receiving broadcast signal uses the regional code to provide an audio message of relevant traffic information to the user in the audio system. This device is a receiver of regional traffic signals that are broadcast on TV SAP carriers. The signal is received by the antenna and delivered to the car radio as a separate audio program (SAP) and is available when the AM radio is tuned to a particular frequency This receiver does not function as an emergency broadcast signal transmitter that provides emergency alerts to a plurality of user devices according to user needs.

U.S. Pat. No. 5,880,720 to Iwafune, et al. discloses a television system for providing interactive television programs and a server system for constructing the television system. This television system has two-way television sets that communicate with a server via a communication network. Each interactive television includes a program control unit for controlling interactive data exchange between a viewer and a response-receiving unit for identifying a response from the viewer to the program from input signals to the television. The communication control unit controls communications with other nodes. The server includes a communication control unit for controlling communications with other nodes, a program information database storing procedures in units of programs, and a response processing function for arranging response data in units of programs. This device transmits TV programs to each of individual connected television receivers as an interactive television program that is delivered along with standard on the air television program. The interactive television program is selected by the user of a television receiver. This system does not function as an emergency broadcast signal transmitter that provides emergency alerts to a plurality of user devices according to user needs.

U.S. Pat. No. 6,204,761 to Vanerable discloses a weather alert system. This weather alert system warns a user when an emergency signal has been broadcast and to simultaneously activate a television or other visual information source and to select a predetermined informational channel. The weather alert system includes a signal detector for detecting a broadcast alarm signal and for generating an activation signal upon detection of the alarm signal. A remote controller is operatively connected to the signal detector for producing a remote control signal in response to said activation signal. The remote control signal is utilized to trigger the activation of a visual information source such as a television or a computer to provide visual information relating to the hazardous condition. This system receives a weather alert and turns on television to a specific channel when the weather alert system issues an emergency signal. When a NOAA alert broadcast is received, the system turns on the wired or wireless remote control of a television to a particular alert display channel, thereby alerting the television user of the weather emergency alert message. This device is receiver of NOAA broadcasts, but does not function as an emergency broadcast signal transmitter that provides emergency alerts to a plurality of user devices according to user needs.

U.S. Pat. No. 7,100,183 to Kunkel, et al. discloses a system and method for transmitting and displaying targeted information. This system and method is for transmitting and displaying information in a television distribution system or the like. The transmitted information is targeted to a viewer matching particular demographic data. The results of a viewer completed demographic survey are used to generate a database known as a bit mask that is made up of the viewer's demographic data. The bit mask is used to control the particular advertising or other related information that is received by each system viewer. In a first technique, the transmission signal carrying the program or advertisement displayed to all viewers is embedded with one or more codes. These codes are compared to the bit mask to determine whether the viewer fits the desired demographic profile, and should be provided with additional information. In a second technique, multiple ads for demographic selective receipt by each viewer are simultaneously transmitted, and are automatically selected for viewing, depending on the viewer's stored demographic data. This system receives and delivers a plurality of advertisements and serves these individual television users according to the demographic data set in a bit mask of the set top converter box. In this manner only specific advertisements that are pertinent to the demographic area is displayed. The targeted information is not based on the requirements of a user and is not an emergency broadcast message.

U.S. Pat. No. 7,228,555 to Schlack discloses a system and method for delivering targeted advertisements using multiple presentation streams. This system and method deliver channels of presentation streams that carry targeted advertisements in a television service network environment. The system includes a generator for generating a set of presentation streams for each of programming channels, each of the presentation streams in each set having the same programming data but different ads directed to advertiser-specific market segments of different advertisers. A plurality of local routing stations receive the generated sets of presentation streams. At least one local routing station processes the sets of presentation streams and selectively switches between the presentation streams in each set to output one presentation stream for a programming channel. As a result, a presentation stream carrying the most appropriate ad is provided to a viewer at any given time for at least one programming channel. This system delivers targeted advertisement streams through multiple streams to a television service environment. Significantly, Schlack discloses a system and method for delivering targeted TV advertisements to subscribers or groups of subscribers in a television service network system, such as a digital cable system, a Switched Digital Video (SDV) system, or a Digital Broadcast Satellite (DBS) system. However, in producing the multiple presentation streams, the MPS generator 40 receives one programming stream for every programming channel from a programming generator or other source. Then, the MPS generator 40 produces multiple copies of the programming streams according to the number of presentation streams allotted for each programming channel. As a result, each programming channel will have multiple copies of the same programming stream having the same programming data, and same avail (ad insertion point) size and location. Then, the MPS generator 40 inserts appropriate ads into the avails of the programming streams according to the ad schedule provided by the ad scheduler 44. Significantly, this process produces a plurality of presentation streams CC-1, CC-2 and CC-3 for the CC (Comedy Central) channel, and a plurality of presentation streams MTV-1, MTV-2, MTV-3 and MTV-4 for the MTV channel. The presentation streams CC-1 to CC-3 carry the same CC programs, but different ads directed to different market segments. Similarly, the presentation streams MTV-1 to MTV-4 carry the same MTV programs, but different ads directed to different market segments. As such, the Schlack system requires all the presentation streams to include at least one version of an advertisement at the same time. Thus, all users will always perceive some sort of program interruption at the same time. This system does not broadcast general emergency alerts to a plurality of user devices based on user needs.

U.S. Pat. No. 7,444,657 to Kendall, et al. discloses an event masking for a television signal receiver having an emergency alert function. The television signal receiver has an emergency alert function and provides a masked list of emergency events during a user setup process for the emergency alert function. The emergency alert function will be activated when certain important emergency events occur. The television signal receiver includes a memory operative to store data associated with the emergency alert function. A processor is operative to receive an input representing a geographical area and to enable generation of a masked list of emergency events responsive to the input using the data in the memory. The masked list of emergency events represents a subset of all emergency events associated with the emergency alert function. A TV display shows an emergency list based on the masked list. The user must input into the TV receiver appropriate emergency transmission frequencies and the geographical location of the user so that appropriate emergency information may be delivered. The '657 patent does not disclose a device that transmits an emergency broadcast to various devices according to user needs.

U.S. Pat. No. 7,592,912 to Hasek, et al. discloses an emergency alert data delivery apparatus and methods. Emergency alert data (e.g., EAS messages) are efficiently and flexibly provided to subscribers of a content-based network, such as for example Internet protocol television (IPTV) subscribers. The apparatus includes a server performing real-time receipt and encapsulation of the EAS data (which may comprise audio, video, and/or text), transport of the EAS data to client devices over the network, and use of one or more applications running on the client devices to decode and display/present the EAS data in a manner which effectively guarantees that it will be perceived by the viewer. Instant messaging (IM) infrastructure is used to authenticate clients and receive and display at least portion of the EAS data via a separate transport process. Server and client-side apparatus adapted for EAS data receipt, decoding and display are also disclosed. Significantly, the Hasek patent discloses apparatus and methods for the delivery of digital media data (e.g., text, video, and/or audio) over networks such as the Internet, and specifically in one aspect to delivering emergency alert system (EAS) data in a broadcast "IPTV" network. Specifically, the Hasek patent discloses an apparatus capable of selectively providing emergency alert data to a plurality of client devices receiving content transmitted over a packet-switched network. Essentially, the apparatus seems to require a database of receivers that is to be checked when an EAS is received by the broadcaster. Then only those receivers within the geographic area to which the EAS relates will be sent the message. This database has to be created and continually maintained in order for the system to function properly. The apparatus does not broadcast emergency broadcast everyone having various devices according to user needs.

U.S. Pat. No. 7,646,774 to Kim, et al. discloses method of processing traffic information and digital broadcast system. This digital broadcast transmitting/receiving system and a method is for processing traffic information data. The method for processing data may enhance the receiving performance of the receiving system by performing additional coding and multiplexing processes on the traffic information data and transmitting the processed data. Thus, robustness is provided to the traffic information data, thereby enabling the data to respond strongly against the channel environment, which is always under constant and vast change. The Kim device accumulates and analyzes traffic patterns along a route and communicates to the driver a prediction of traffic congestion along the route. This Kim receiver does not function as an emergency broadcast signal transmitter that provides emergency alerts to a plurality of user devices according to user needs.

U.S. Pat. No. 7,665,106 to Kim, et al. discloses an emergency alert signaling method and digital television (DTV)

receiver. A terrestrial digital television receiver includes a tuner, a microcomputer, and a demodulator. The microcomputer initially determines whether the DTV receiver is on, a power-on or power-off mode. If the DTV receiver is on the power-off mode, the microcomputer, control operation of the tuner to tune to a predefined emergency alert channel to receive a master guide table. The demodulator parses the master guide table. If the parsed master guide table indicates that a new emergency alert message is being received, the microcomputer automatically sets the DTV receiver on the power-on mode and controls operation of the tuner to tune to the emergency alert channel. In this system, the microcomputer of a digital television determines if an emergency broadcast is received and turns on the digital television to an emergency broadcast channel. The Kim device can turn on or turn off the digital TV and tune to emergency channels according to the emergency alert table. The digital TV tunes to terrestrial broadcast of emergency information when new emergency alert message is received. The Kim device is a receiver of emergency broadcasts and displays the emergency information on a digital TV. This Kim receiver does not function as an emergency broadcast signal transmitter that provides emergency alerts to a plurality of user devices according to user needs.

U.S. Patent No. 2002/0056107 to Schlack, et al. discloses a system and method for delivering statistically scheduled advertisements. This system and method is for scheduling advertisements in a television service network environment. An ad scheduler prepares an ad insertion schedule based on channel change statistical information and avail time information. The scheduler evaluates the statistical information, time durations between adjacent avails in a presentation stream, and the relatedness of market segments assigned to a plurality of advertisements. It schedules the ads into presentation stream groups based on this evaluation. The statistical ad scheduling allows the system to eliminate "forced" switching between multiple presentation streams, whereby system wears and malfunctions can be decreased. Significantly, the Schlack device is directed to scheduling and inserting plurality of advertisements in to different TV programs according to demographic locations and the schedule of advertisements is maintained. The Schlack device only delivers groups of advertisements, not emergency alert messages.

U.S. Patent Application No. 2006/0242652 to Silverbrook, et al. discloses a configurable alert notification system and method. This configurable alert notification communications system includes an audio receiver for detecting a discrete signal transmitted by a message dispatch system, and a computer connected to the audio receiver for recording in a first format an audio message associated with the discrete signal. The audio message in the first format can be converted to at least one of a plurality of dissimilar formats, and it can be further converted to a new format different from the dissimilar formats as specified by an end user company. The one or more formats are sent to corresponding servers configured to accept these formats, which are in turn transmitted to a recipient on the mobile device of his choosing. This Silverbrook device receives audio data and converts the data to different audio formats using a computer including WAV file, MP3, WMA, Quick time and RealAudio formats and delivers the formatted audio message to users. The Silverbrook device is in essence a receiver; it does not function as an emergency broadcast signal transmitter that provides emergency alerts to a plurality of user devices according to user needs.

U.S. Patent Application No. 2008/0085695 to Vare, et al discloses an emergency Alert and Delivery Framework for Broadcast Systems. Provided are apparatuses and methods for efficient and timely broadcasting of emergency information over any system by at least one transport protocol supported within each system, e.g., in DVB-H it is carried as an IP stream or as filecast, and within other DVB systems, can be supported as audio, video, or data and even as IP. Systems and methods are provided by which urgent emergency information or other information that needs immediate action(s) can be signaled to an end user. Essentially, Vare discloses an emergency alert and delivery framework for use with a broadcast system, wherein an end user consumes services in a normal manner. In the case of an emergency, however, an emergency alert may be provided via an interaction network to an emergency information server. Emergency message may be outputted from emergency information server and may replace all services, including previously used service to user device via emergency message transmitter. The previously used service may be entirely replaced by the emergency message. Services, including but not limited to standard service and emergency message service is made available to user cell phone device via broadcast network, or a cellular network. This emergency alert framework delivers emergency information only to cell phones and does not function as an emergency broadcast signal transmitter that provides emergency alerts to a plurality of user devices according to user needs.

47 CFR Part 11 details the Emergency Alert System (EAS) and associated documents. The EAS is primarily under the responsibility of the Federal Communications Commission.

Based on the foregoing, there exists a need for an emergency alert system that provides tailored messages for first responders, policemen, ambulances and the like in their previously programmed devices so that their actions can be coordinated while a general emergency alert is broadcast to general public. Such a system will prevent everyone from hearing an emergency alert message that is diluted without specific detailed instructions to key personnel.

SUMMARY OF THE INVENTION

The present invention provides a system for transmitting emergency broadcast messages with selectivity to radio, television, computers and smart phones. Generally stated, the system comprises: i) analyzing of an incoming EAS Message for intended recipients and determine their course of action; ii) encoding of the received message as a coded stream for the receipt of the message by intended recipients, for example first responders; iii) each message being proceeded with a specific code followed by an emergency alert message and a final emergency alert message being terminated by a delimiter followed by an emergency alert message for general public; iii) digitally transmitting the new encoded EAS Message (either alone or in combination with regular programming or data) to the entire receiving audience; iv) enabling designated, e.g. first responders, reception devices, each having specific code; v) receiving the encoded EAS Message or generic message for the general public as an appropriate audience; and v) causing non-enabled and legacy devices to present the EAS message to the generic end user without being burdened with additional information intended for others.

This retransmitted emergency alert message transmitted has a unique data structure. Each message delivered to a specific first responder that may include police, fireman, ambulance, and the like is preceded by s special code that is the same as the code present in the specific first responder's receiver. The retransmitted emergency messages have special codes before each of the emergency alert messages. In addition, each special code is earmarked for specific first responder. The messages with special codes are finally terminated by a delimiter followed by an alert message for the specific receiver category or the general public. The message to first responders that may include police, fireman, ambulance, and the like may be a television message, audio message and or computer data, and can only be received by devices that have the special code present within the device. The general public alert message may include a television message and/or audio message, capable of being played by generic devices, and could be a digital or analog message.

The retransmitted broadcasting system of the subject invention receives the EAS message from an external broadcast source and has capabilities for including video frames, audio messages and computer data either as an addition or as a replacement of the original EAS message content. The retransmitter also adds a number of special codes in front of each of the retransmitted messages to each of special first responders, which may include police, fireman, ambulance, and the like followed by a delimiter and an uncoded message for general public. Each of the receiving devices of the special first responders are previously programmed with a specific special code and only receives the retransmitted emergency alert message that has the very same special code proceeding the emergency alert message, while all other portions of the retransmitted message are ignored. A generic device which may be a television or an audio receiver only receives the uncoded emergency message that is intended for general public, the message content that is free from instructions to special first responders. Since the transmission of the retransmitted message is digital, it can pack a large amount of coded and uncoded data and transmit at high speeds. For example, the uncoded emergency alert message may be received through the Internet by a television broadcaster or audio broadcasting station and may be sent through cable, satellite broadcast or over the air to all television or audio receivers.

Briefly stated, the system for transmitting emergency broadcast messages with selectivity to radio, television, computers and smart phones comprises: i) a means for receiving an emergency alert system broadcast message; ii) means for analyzing an incoming EAS Message for intended recipients and determining each of their course of action; iii) means of encoding the received message as a coded stream for the receipt of the message by intended recipients, for example first responders; vi) such encoding step optionally including the step of adding video messages, audio messages and or computer data that may be appended to the received EAS message or created as an entire replacement; v) each message being proceeded by a specific code and followed by an emergency alert message and a final emergency alert message that is terminated by a delimiter followed by an emergency alert message for the general public; vi) digitally transmitting the new encoded EAS Message either alone or in combination with regular programming or data to the entire receiving audience; vii) enabling designated devices, e.g. first responder reception devices, to receive an emergency alert message specifically tailored for their use, each device having a specific code viii) members of the general public receiving the uncoded portion of the EAS Message; v) causing non-enabled and legacy devices to present the EAS message to the generic end user without being burdened with additional information intended for others, that is, a public mode and a private mode are provided in the system.

The system for transmitting emergency broadcast messages with selectivity to radio, television, computers and smart phones, confers many benefits:

1) It is designed to work in conjunction with currently implemented EAS systems;

2) EAS messages are encoded for receipt by a specialized category of recipients, e.g. first responder. Fireman, police, ambulance, and the like while the details of code assignment are beyond the scope of this patent disclosure;

3) Digitally broadcasting the encoded message to everyone, not just a subset of known recipients;

4) Receivers configured for specific audiences, e.g. first responders, such that they display EAS messages meant for that audience;

5) Broadcasting messages in a fashion such that legacy devices can still receive and present the generic Emergency Alert Message;

6) All devices being able to receive an EAS message and the system deciding by special codes if and how that message will be presented to the end user;

7) The system has special codes for each of the responders and special personnel devices, and casts the emergency alert message instructions according to their needs thereby providing a coordinated effort to address the emergency while the general public only receives a general emergency alert message.

8) A variety of other messages may also be transmitted in a different mode.

9) Other capabilities that may be provided by software means that may include but not be limited to; A) The presentation of the word "Earthquake" and possibly other(s) for more rapid alerting at the receiver. B) Selective advertising content to different areas. C) Reliable transmission by transmitting thrice with checking or using Forward Error Correction (FEC). D) An automated quality control system that includes present EAS transmission, with Bit Error Rate (BER) and may include monitoring of the "health" of the equipment. E) A means to calculate the value of the message delivered to justify the budget. F) The ability for limited ability of operators to originate alerts as has been shown to have value. G) The means to transmit limited video and some audio including alerts such as when a facility has to be evacuated for an extended duration. H) The displayed character size and display rate can be set by the user e.g. for the partially blind. I) On satellite systems, the emergency messages may be for an extended area, and prioritization in a shared distribution is provided for. J) The continued display of vehicle IDs in AMBER Alert is provided for. K) School weather closing messages, which are usually extended, are provided for as well as the ability to receive program audio is preferred. L) Receivers may have various ways to input latitude and longitude data e.g. USB, Bluetooth or vehicle navigation system. M) Configurations to input latitude and longitude data e.g. USB, Bluetooth or vehicle navigation system. M) Configuration and software can be periodically checked for correctness using scrubbing software, for improved reliability. N) An automation system may be interfaced to better harmonize alerts and regular program playout, for improved experience by the public. O) Periodic transmission of the date and time can be used to synchronize clocks, e.g. clock radios. O) Navigation systems can advise on routes out of an emergency area, or display a flooded area or major highway problem. P) Originators may include "Message Insertion Opportunities" using coding in the PSIP (Program Supplementary Information Protocol) or PMCP (PSIP Metadata Control Protocol) for downstream use. Q) Complete CAP message data can be transmitted so if an area does not have Internet reception of the CAP message, one can be regenerated locally for appropriate usage. R) All TV systems can operate with this system.

S) Intercom audio on TV can be transmitted with low latency.
S) Bandwidth on TV is conserved as digital muted audio has no data.

BRIEF DESCRIPTION OF THE DRAWING

The invention will be more fully understood and further advantages will become apparent when reference is had to the following detailed description of the preferred embodiments of the invention and the accompanying drawing, in which.

DETAILED DESCRIPTION OF THE INVENTION

Figure 1A:
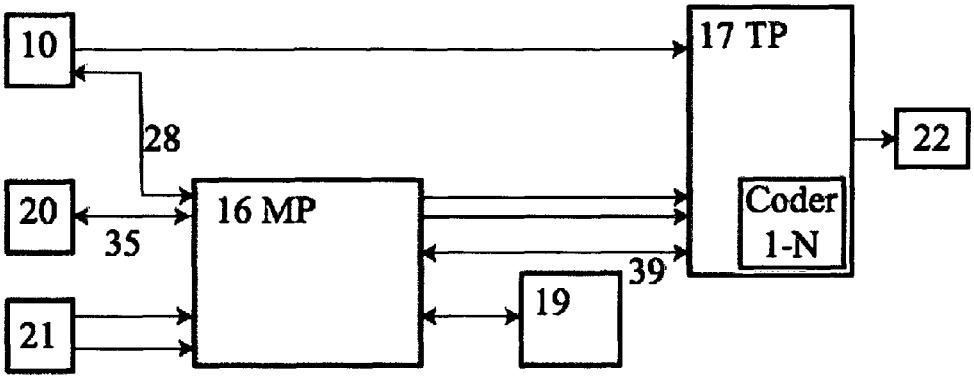
FIG. 1*a* illustrates a broad view of a first embodiment of the Selective Message Transmission System applicable at an originator or digital retransmitter or distributor location for example of broadcast TV.

This invention relates to a system for transmitting emergency broadcast messages with selectivity to radio, television, computers and smart phones. The system receives the emergency alert system message, analyzes the data and determines how the data should be delivered to first responders and the like. These special participants may require coordinated instructions along with specific time frames to provide emergency information. The system decides what each special responder should receive, which may be television images, audio stream as well as computer data. In order to designate which special responder should get a specific message, the system adds a specific unique code before the beginning of the retransmitted emergency alert message and can only be received by special first alert responder devices that is programmed with an identical unique code. The digitally broadcast alert message is a sequence of special codes and specially cast messages. When the last message in the digital emergency message is complete, the system adds a delimiter signaling that all special responder messages are completed and is followed by uncoded message intended for the general public or private mode. Since the retransmitted emergency alert message is digital, it can be broadcast at high transmission speeds and may be broadcast using the Internet and other systems. A user device connected to the Internet can receive the retransmitted emergency alert message, and acquire the message intended for the user device that has a matching code. Legacy devices such as a television or radio broadcasters, which can only access the generic public information and may rebroadcast to local televisions and radios, may receive the retransmitted emergency message. This system may be used for emergency alerts, including weather related problems, earthquakes, fire emergencies, traffic accidents and road closures and the like as well as amber alerts. Non-emergency-alert messages may also be transmitted in private mode and received by receivers described herein.

The Emergency Alert System (EAS) is a national public warning system that requires various broadcasters (e.g. cable television systems, wireless cable systems, satellite digital audio radio service (SDARS) providers, and direct broadcast satellite (DBS) providers) to provide the communications capability to the President to address the American public during a national emergency. The system also may be used by state and local authorities to deliver important emergency information, such as AMBER alerts and weather information targeted to specific areas. Transmissions may comprise text, audio (including the spoken word), still pictures, moving pictures or some video, computer generated graphics or video (hereinafter referred to as CG), and other data.

When the message is a warning alert, there is effectively no implemented method in current consumer receivers to select whether or not it shall be presented to a listener or viewer, with the exception of the closed captioning or descriptive text system or the alternative language audio system. In the case of messages for emergency alerts, civil authorities deem it a matter of importance that any technology developments do not prevent messages from being received by those who have not purchased the latest technology. Normally, when some process of selection is implemented, it is by directly selecting the group of individual units. However, it has been recognized that there are flaws in contemporary emergency alerting systems. One such flaw is the problem of over alerting where messages are received by unintended recipients. For example, a message meant for a county is received by the populous of an entire state; or, a message meant only for first responders—e.g. during emergency responsiveness drills—, would be received by the general public, which could lead to problems including a general panic of the citizenry. For example, in the case of television emergency messages, presently available technology provides a display of text of the emergency message on the screen. This display commonly is a red horizontal background band with white text inserted.

One object of the Selective Message Transmission System is to address this problem by selecting all individual units to receive the message and then to implement technology such that according to a selection criterion, a group of individual units may be able to avoid presenting the message to the listener or viewer if the technology were implemented. Such viewers or listeners would be able to see or hear what would be a normal program content continuing without apparent interruption. In one embodiment the Selective Message Transmission System discussed herein provides for the receiver to be able to insert the text band internally. With this embodiment, it may be possible to not insert the text band at the station at some time in the future when it is practical and deemed acceptable by civil authorities.

Generally stated, the system for transmitting emergency broadcast messages with selectivity to radio, television, computers and smart phones comprises: i) a means for receiving emergency alert system broadcast message; ii) means for analyzing an incoming EAS Message for intended recipients and determining each of their courses of action; iii) means of encoding the received message as a coded stream appointed for receipt by intended recipients, for example first responders; vi) such encoding including the step of adding video messages, audio messages and or computer data that may be appended to the received EAS message or created as an entire replacement; v) the each message being proceeded by a specific code followed by an emergency alert message and a final emergency alert message that is terminated by a delimiter followed by an emergency alert message for the general public or private mode; vi) digitally transmitting the new encoded EAS Message either alone or in combination with regular programming or data to the entire receiving audience; vii) enabling designated devices, e.g. first responder reception devices to receive an emergency alert message specifically tailored for their use, each device having a specific code, for example by category or location; viii) members of the general public receiving the uncoded portion of the EAS Message if it is not in the private mode; v) causing non-enabled and legacy devices to present the EAS message to the generic end user without being burdened with additional information intended for others.

One process usable in the EAS message system is that of Program Identifier (PID) switching in digital broadcasting. Normally there are two audio channels in audio PIDs. One PID carries stereo program, a second PID may carry the alert audio in the private mode. When the alert is broadcast to the public, the PIDs are switched. This process is most suitable if there is one language. A second process is to have each emergency message language in a separate audio channel. These are passed through at the same time whichever language is selected as the primary language by the broadcaster for digital TV. For digital radio, the languages are passed through in the order primary, secondary, tertiary and quaternary etc. order as defined by the emergency management. In both cases the broadcasters' primary language is transmitted as replacing their program output, and the normal programming is continued on a second PID. For digital radio, an alternate process is to force switch all receivers to the analog audio for the alert duration, and receivers with the feature that are not selected can continue listening to regular program on the digital channel. Receivers with the feature that chose a secondary, tertiary or quaternary language, as defined by the emergency management, and are selected for alerts, can present the audio for the selected language also when it reaches the receiver. In all processes, the station text shall include all languages, but the receiver generated text display may be the users preferred language. A third process may be to apply the selection of channels or streams in a multichannel compressed audio technology such as Dolby Digital. The Dolby patents are applicable within the Dolby processing and audio transmission, but do not cover the methods incorporated here. Provision for compressed or encoded audio such as Dolby is not drawn, but basically there would be such audio with alerts and program audio without alerts provided for. In radio, there is the option to force tune legacy HD Radio receivers to the analog audio if they do not have this emergency alerting feature. Other processes, or variations of these processes, are possible. Additional languages may also be provided for. Transmission on computer networks may be by using ASI (Asynchronous Serial Interface) over IP (Internet Protocol), though the data may be transmitted using TCP (Transmission Control Protocol) instead of UDP (User Datagram Protocol). The use of an auxiliary processor with latency means that addition processing is required to reduce the latency of the emergency audio and video. The use in digital radio is modified in that there is no video, but there is an analog audio channel, which may be stereo, and also memory play out may be used for some messages to reduce time and bandwidth used. The replacement of the alert message video with the original program or other message video is by using a keyer to select that video content only, with the rest of the picture being black. The boundaries would the 8 pixel boundaries that compression systems use. Then a second compression system transmits this limited data and it is synchronized with the primary compressor using Program Clock Reference (PCR). The GOP (Group Of Pictures) of the two compression systems should be synchronized. At the receiver, this data, if selected by the message criteria, would replace the data for the same blocks of the main video compressor. Then the resulting data is decompressed.

FIG. 1*a* illustrates a broad view of a first embodiment of the Selective Message Transmission System applicable at an originator or digital retransmitter or distributor location, shown generally at 10. Program source means 10 may be a broadcast station master control, a receiver in the case of a translator or other source with audio, and may include video and/or data. Program source means 10 is interconnected to a message processor (MP) 16 and a transmission processor (TP) 17 by way of audio line 28 for providing audio from the program source means 10. A remote version of a Front Panel Interface 19, and/or a Keyboard Video Mouse interface, is interconnected with MP 16. A computer network source 20 or destination for messages and other data is connected by way of a computer network connector 35. At least one receiver antenna 21 is provided; however, multiple receiver antennas 21 may be provided for multiple receivers. A transmission system 22 is interconnected to the transmission processor 17. A control line 39 is interconnected for transmitting data and/or control signals and message information to the TP 17. The element TP includes coder 1-N inserting specific code followed by a message to a specific user device and this step is repeated for all the specific device users 1-N. At the end of special user message, a delimiter character is inserted followed by an uncoded public message that may be received by any device.

Figure 1B:
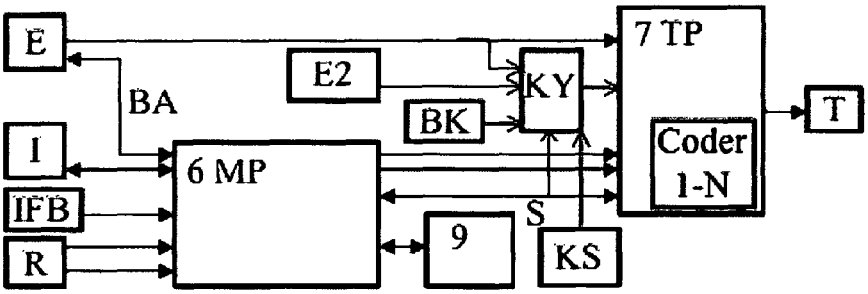
FIG. 1*b* is an alternate embodiment of FIG. 1*a* and has additional elements of the retransmitter for example of broadcast TV is shown.

FIG. 1*b* is an alternate embodiment of FIG. 1*a* and has additional elements of the retransmitter shown. The System/Method for Transmitting Messages with Selectivity comprising a program source means E. Element I is a computer network source or destination for messages and other data, and/or an automation system. Element IFB is an intercom audio source. Element R is a receive antenna. Element MP in box 6 is a message processor. Element E2 is a second program source. Element KY is a keyer with input selection. Element BK is a video blockblack signal and element KS is a key signal. S is the control line. Control of the keyer input selection and the key signal generator may be accomplished by various means. If the KY input is fed to the TP, then this is not a regular video compression processor, but one with dual compression modules, which have their program clock reference (PCRs) synchronized and the PIDs associated. E2 Audio may be transmitted via the same means as emergency audio and selected if appropriate. This arrangement is not shown. Local area network, wide area network and other control cables are omitted for simplification and scope limitation. The element TP includes coder 1-N inserting a specific code followed by a message to a specific user device, and this step is repeated for all the specific device users 1-N. At the end of a special user message a delimiter character is inserted followed by an uncoded public message that may be received by any device, or a separate message may be transmitted.

Figure 2:
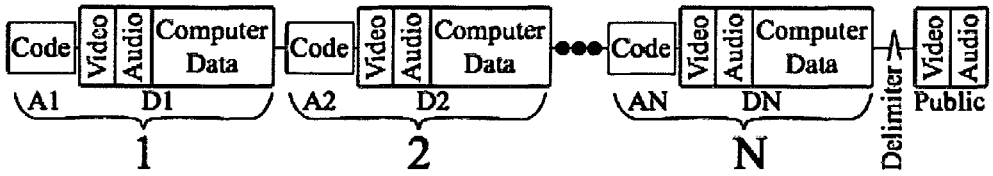
FIG. 2 illustrates the data structure of the digitally retransmitted emergency message capable of being received by specially coded first responders and general public and the data structure may be packets in a TCP/IP transmission or may be separate program IDs in a broadcast system.

FIG. 2 illustrates the typical data structure of the retransmitted digital emergency alert signal. The special code A1 of the first responder receiver is followed by data D1 which may include a video file, audio file and computer data. This data delineated as 1 is followed by data 2, which includes special code of the second responder A2 followed by data D2. In a similar manner N data sets are accumulated. A delimiter is added to the end of the $N^{th}$ data indicating the end of special emergency alert messages and is followed by a delimiter and by a public emergency broadcast message all of which is accumulated as a data string and is retransmitted by the system as the digital emergency alert message.

Figure 3:
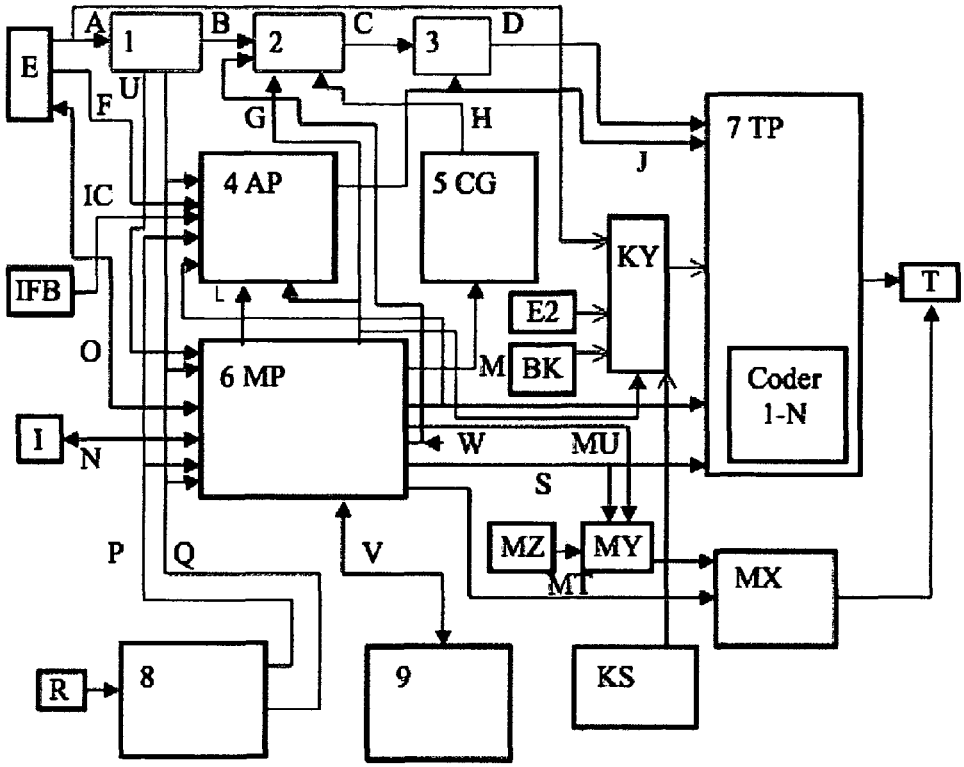
FIG. 3 illustrates a diagram of another embodiment of the Selective Message Transmission System, for example broadcast TV applicable at an originator or retransmitter or distributor location, wherein components are not combined as in FIG. 1 above.

FIG. 3 illustrates a diagram of another embodiment of the Selective Message Transmission System applicable at an originator or retransmitter or distributor location wherein components are not combined as in FIG. 1 above. This diagram is applicable at an originator or retransmitter or distributor location. Devices, sources and destinations are numbered boxes.

The key functional elements are detailed herein below. Box 1 is an optional audio de-embedder that extracts audio from video with embedded audio. It may also be a data de-embedder or that may be a separate, adjacent device. Box 2 is an optional video keyer that inserts video from a different source into the program video. This box may also include, or have in cascade, a video delay in the event that Dolby Digital or some other audio processing requires a matching video delay. Box 3 is an optional audio embedder that embeds audio into video. Box 4 is an audio processor, hereinafter referred to as AP. There would be multiple output channels. This box is optional if the function is provided for in another device identified e.g. the Transmission Processor. Box 5 is an optional computer graphics or character generator device or CG. Box 6 is a message processor, hereinafter referred to as an MP. Box 7 is a transmission processor, hereinafter referred to as TP. There may be other inputs to this processor and more than one output. Box 8 is a message receiver, there may be more than one of these, but they would all be similarly connected with regard to the function. Box 9 may be a remote version of a Front Panel Interface, and/or a Keyboard Video Mouse interface. Box I is a computer network source or destination for messages and other data, and/or an automation system. Box R is a receive antenna, or multiple antennas if required for multiple receivers. Box T is a transmission system. This may be a broadcast transmitter, fiber optic or coaxial cable system, or uplink to satellite, or other transmission means, and may also be some combination of the aforesaid. Box MX is a radio text transmission system, which uses a different protocol, e.g. RDS or RDBS. IFB is an intercom audio source, if used, for low latency audio. The element TP includes coder 1-N inserting specific code followed by a message to a specific user device and this step is repeated for all the specific device users 1-N. Each user device gets instructions according to the functions performed by the user. At the end of special user message, a delimiter character is inserted followed by uncoded public message that may be received by any device, or a separate message may be transmitted.

Interconnections are lines with at least one arrow, and each has a letter. If there are multiple destinations for one source, this is indicated with multiple arrows. An exception to this is line N, which is bidirectional and is a computer network connection which may have multiple other devices connected. Line S may also be part of line N or a separate computer network connection. Box E is a program source. This may be a broadcast station master control, a receiver in the case of a translator or other source with audio and may also include video and/or data. Line A is optional video and also may be optional embedded audio. Line B is optional video. Line C is optional video with CG video inserted. Line D is optional video with CG video and program audio plus any message audio inserted. There would be multiple audio channels. Line F is audio from the source E. Line G is a control line, which may comprise multiple controls, from the MP to the AP and optionally to the video keyer. Line H is video and optional keying signal from the CG to the video keyer. Line J is audio from the AP and optionally to the TP or to the audio embedder. Line K is message audio from the MP to the AP or optionally to the TP. Line L is a different control signal from the MP to the AP, and is optional. Line M is a data line from the MP to the CG, and provides message text, formatting and other control data. Line N is a computer network connection. Messages may be received on this line. Reports and other responses and/or user interaction and/or automation system interaction may take place on this line. Line P is audio from a monitoring receiver to the AP, which may be multiple channels. It may optionally go to the MP. Line Q is data from a monitoring receiver to the MP. Line S is a control line transmitting data and/or control signals and message information to the TP. Line U is an optional data line from the data output of 1 to the MP. Line V may be one or more user interfaces, which are local or remote. Line W from the MP to the keyer alternate or backup input. This provides a backup video source in case the program source is unavailable or deselected. Line IC is intercom audio.

Boxes 2 and 5 may be combined. Boxes, 6, 5, and 2 may be combined. Boxes 6 and 5 may be combined. Boxes 4 and 7 may be combined. Boxes 2, 3, 4, and 7 may be combined. Boxes 8 and 6 may be combined, and in some aspects are now available as such. A combination of combinations may also be made.

Not drawn is an audio compression encoder processor, of which more than one may be used. Such processors output may connect to the audio embedder or back into the audio processor to select which, if any, audio compression processor is used. An example application is Dolby Digital, which is a method for transmitting surround sound. An audio compression decoder processor may also be required for the incoming source to the audio processor.

The received emergency alert is modified by use of various elements of FIG. 3 prior to retransmission at T according to the needs of each of special responder receivers.

Figure 4:
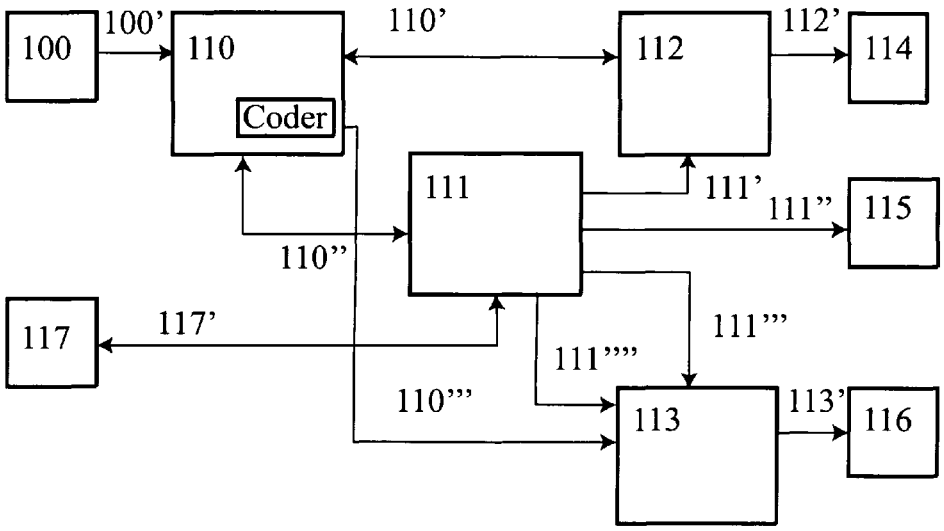
FIG. 4 illustrates an embodiment wherein a subsystem is provided that is a modified radio or television receiver or a receiver that is installed in a computer or a computer network device capable of receiving encoded emergency alert messages.

FIG. 4 illustrates another embodiment wherein a subsystem is provided that is a modified radio or television receiver or a receiver that is installed in a computer or a computer network device. When radio or TV is received by a receiver in a computer, the audio, data and video may go to different subsystems. This provides for the said video and audio, or audio only in the case of a radio receiver, to have the emergency message inserted in an appropriate manner. In addition, the data received may be sent to a recipient device or system. In the case of a receiver for a fire alarm PA system or some other PA system, the audio may only be accompanied by a control signal as a data output. An antenna 100 is provided for receiving broadcast transmissions or a receiver of coaxial cable or fiber-optic transmissions or Internet. Antenna 100 is interconnected to a tuner 110 and demodulator, or demodulator only, or a data selection device with an optional output of video, an optional output of audio, and an output of data by way of line 100' representing a received signal or data. The demodulator uses the special receiver code to select only the portion of the retransmitted emergency alert message that pertains to the specific user device. Tuner 110 is interconnected to a message processor 111 with an output to a video subsystem, an output of data, and an output to an audio subsystem to provide data 110'. The Tuner 110 also contains the video and audio decoders. As controlled by 111, the video from the second encoder may be inserted into the data to be decoded. The connection is bidirectional for this purpose. The replaced data is most likely to be a different amount from the replacement being inserted. The methods of assigning a preset block and/or using null characters SHOULD NOT be used as the size is not defined. The methods of using jumps and returns, or alternatively inserting and shuffling the following data up or down SHOULD be used. While an alternative method of using two separate decoders and replacing the resulting video area before displaying is possible, and included in this patent scope, the cost of implementing this is expected to be higher and so not anticipated to be used in the majority of consumer TV designs. A video subsystem 112 is provided adapted to generate graphics that may be superimposed on the incoming video via optional video line 110". An audio subsystem 113 is adapted to select an audio source or sources from amongst the multiple channels on the audio input. An optional video display subsystem 114, data destination 115, and/or audio sound output subsystem 116 can be provided. Additionally, an optional external computer system or subsystem 117 separate from data destination 115 may be provided. Optional video line 112', optional audio line 110", data lines 111' and 111", control signal(s) line 111'"110'", data line 111", control signal(s) lines 111' and 111', audio line 111', audio line 113', and data to or from an optional external system or subsystem 117' may each be provided.

Figure 5:
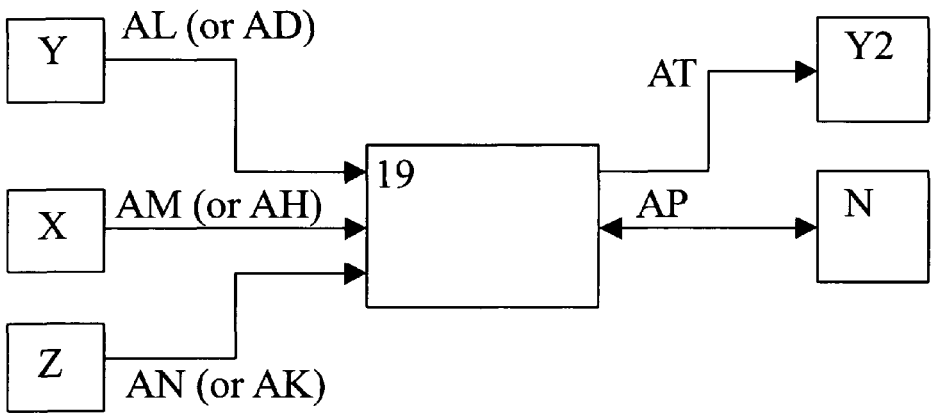
FIG. 5 illustrates an embodiment wherein a subsystem is provided that is a computer receiver.

FIG. 5 illustrates an embodiment wherein a subsystem is provided that is a computer receiver. The audio, video and data may be combined again and put on to a computer network. An example of this is in campuses, where students or other people have computers but not TVs or radios, and their computers are the recipients of such systems as described here. Box 19 is a general-purpose computer, which may physically house the system. Line AL is video and may be identical to line AD. AD corresponds to 112'. If not, then it is because box Y is for doing some further processing. Line AM is data and may be identical to line AH. AH corresponds to 111". If not, then it is because box X is for doing some further processing. Line AN is audio and may be identical to line AK. AK corresponds to 113'. If not, then it is because box Z is doing some further processing. Line AP is a data connection to the computer network. Box Y2 is a smaller or secondary display, which as a minimum function can display text. Line AT is a data line for text display.

Figure 6:
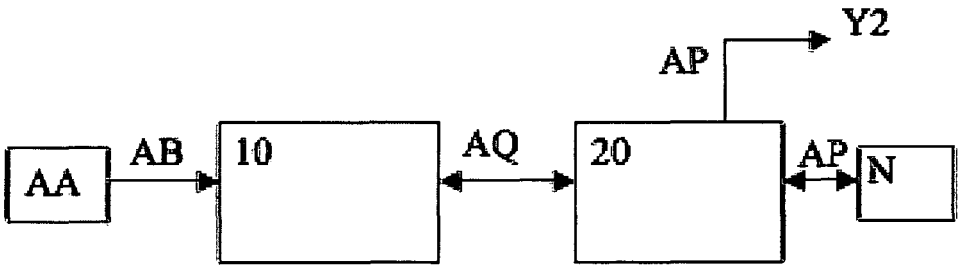
FIG. 6 illustrates an embodiment wherein a subsystem is provided that is a modified computer receiver.

FIG. 6 illustrates an embodiment wherein a subsystem is provided that is a modified computer receiver. Electronic components may be combined into integrated circuits. Integrated circuits may be combined into larger integrated circuits. Larger integrated circuits may be general-purpose arrays of logic whose function is defined by software stored in a memory. The function(s) of hardware may further be combined into software and executed on a general-purpose computer. While the functions described in this patent may be implemented by software operating on the hardware described herein, the hardware may in some form be replaced by software. Box 10 is functionally similar to the same number box in diagram 3, and is a tuner and demodulator, or demodulator only, or a data selection device with an optional output of video, an optional output of audio, and an output of data. Box 20 is a general purpose computer, which may physically house the system. Line AB is received signal or data. Line AQ is data, and may include audio and video as part of the data. Line AP is a data connection to the computer network. Box Y2 is a smaller or secondary display, which as a minimum function can display text. Line AT is a data line for text display.

Figure 7:
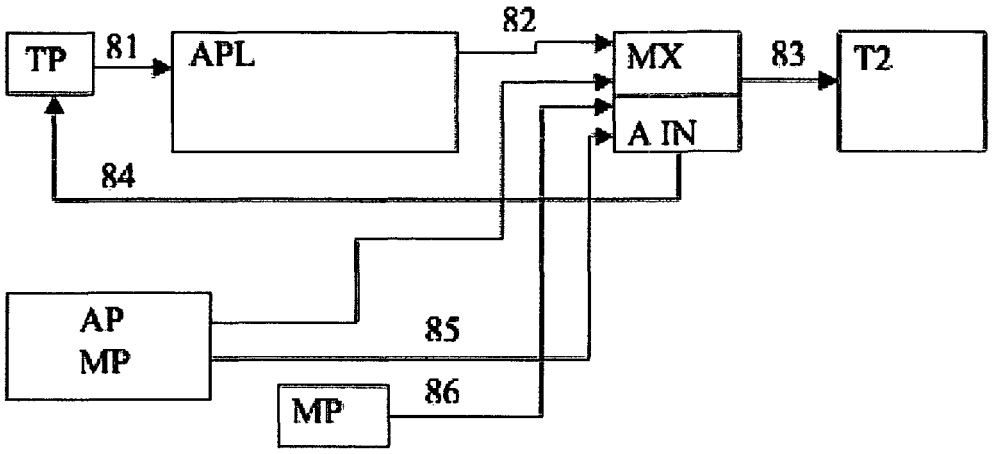
FIG. 7 illustrates an embodiment wherein a subsystem is provided for a broadcast TV.

FIG. 7 illustrates an embodiment wherein a subsystem is provided for a broadcast TV. Line 81 is compressed video, audio and data from the Transmission Processor. Line 82 is compressed video, audio and data with modifications applied by an Auxiliary Processor with Latency (APL). An example of such a processor is processing performed for Mobile or Handheld television. Line 83 is compressed video, audio and data with the addition of low latency audio and data. Line 84 is feedback data to convey the change required to the video compression system to provide more or less data in order to effectively utilize the bit rate available given the change in the requirements of the low latency audio and data transmission. Line 85 is low latency audio for emergency, intercom (IFB), translation or other use. The line referred to is above or below depending on whether the source is AP or MP. Line 86 is low latency data for emergency or other use. This may be more than one input as referred to below. The TP is the TP in FIG. 3. An APL is an auxiliary processor that introduces additional latency in the program audio, video or data. An example of such a processor is processing performed for Mobile or Handheld television. This may not exist, and the source may be different video for mobile or handheld content into the multiplexor MX following in a manner similar to line 86. MX is a multiplexor. The A IN is the audio in which may be uncompressed (e.g. PCM or Pulse Code Modulation) or may be compressed. If it is compressed, a low latency method is most appropriate. T2 is the new point of transmission replacing T of FIG. 3. AP or MP provides the audio outputs of the emergency audio channels. The MP output is actually provided by the data output of the MP message processor. The actual implementation of the FIG. 7 may be separate or the functions may be included in FIG. 3.

Figure 8:
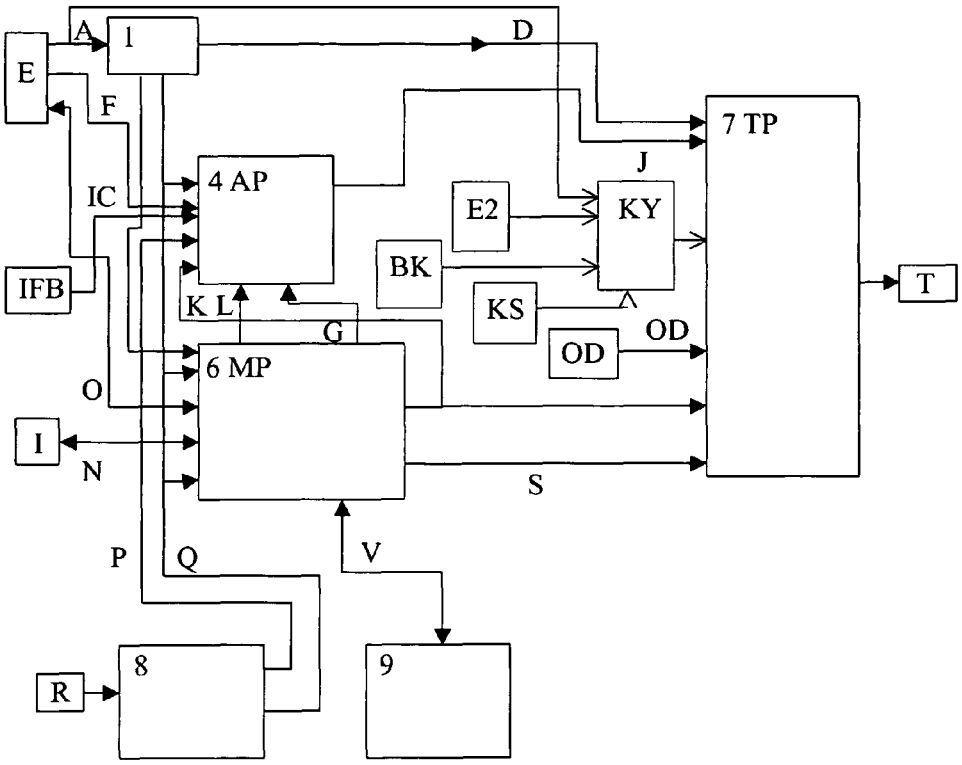
FIG. 8 illustrates an embodiment wherein a subsystem is provided for a broadcast radio.

FIG. 8 illustrates an embodiment wherein a subsystem is provided for a broadcastcable, fiber or satellite radio or TV. This diagram differs from FIG. 3 in a number of respects. There is no insertion of the Emergency Message audio or video into the transmitted program. The insertion of the Emergency Message audio or video is done either at the Set Top Box or receiver or combination of both. The Emergency Message is transmitted on a single carrier. In the case of cable, this is one channel, in the case of satellite, this is one transponder on the same polarization of the same satellite. A benefit of this is to reduce the bandwidth required. The program content may be transmitted on other carriers. Other data may be multiplexed with the emergency data, as suitable bandwidth may be available. This is indicated by the OD source. For an explanation of KY (keyer with input selection), E2 (second program source), BK (video black) and KS (key signal) see claim 110. Control of the keyer input selection and the key signal generator may be accomplished by various means, and are omitted here for diagram simplicity. If the KY input is fed to the TP, then this is not a regular video compression processor, but one with dual compression modules, which have their PCRs synchronized and the PIDs associated. E2 Audio may be transmitted via the same means as emergency audio and selected if appropriate. The GOP (Group Of Pictures) should be synchronized between the two compressors. This arrangement is not shown.

Figure 9:
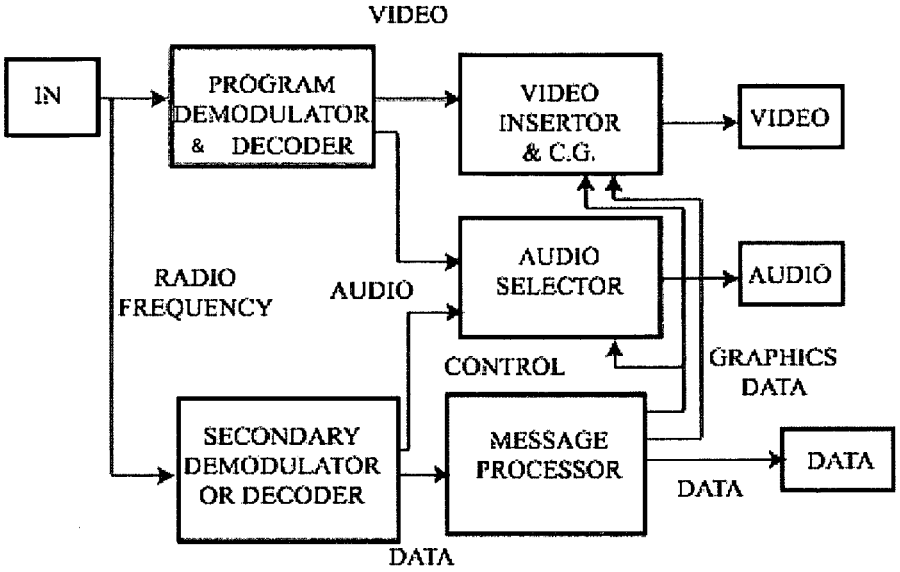
FIG. 9 illustrates an embodiment wherein a subsystem is provided for a cable set top box.

FIG. 9 illustrates an embodiment wherein a subsystem is provided for a cable set top box. The Audio and Video output may be used directly or forwarded to a receiver directly or via a modulator, which is not drawn. The use of other data on the secondary decoder/demodulator is not defined within this patent, but may include graphics for alternative display to the program. The message selectivity is performed by the message processor.

Figure 10:
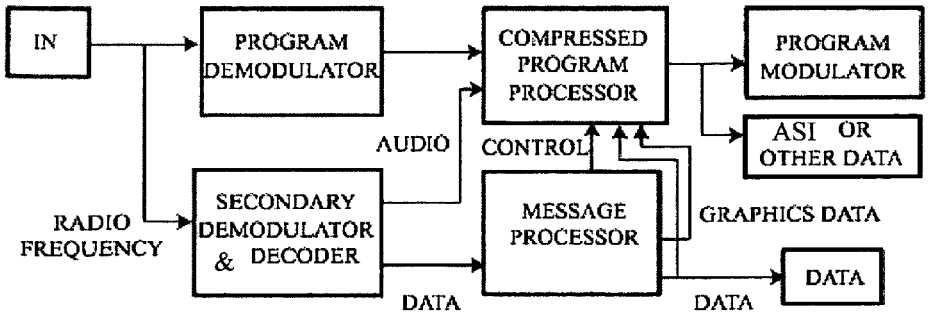
FIG. 10 illustrates an embodiment wherein a subsystem is provided for a satellite set top box.

FIG. 10 illustrates an embodiment wherein a subsystem is provided for a satellite set top box. This figure resembles FIG. 9, but the combining of the message audio, graphics and data is performed on the compressed program. By specifying which lines the graphics is displayed on, the video can be selectively replaced without decompression. This is part of the specification, but not part of this patent because alternatively the graphics processing may be done in the receiver. The modulated program contains either all or a selected portion of the emergency messages. The selectivity of the message to be presented at the output is then either wholly or partly done in the receiver. This includes language selection. The use of other data on the secondary decoder/demodulator is not defined within this patent, but may include graphics for alternative display to the program A single line on any diagram may mean multiple channels, e.g. for audio or compressed video. The device receiving the line may select the channel or channels.

Figure 11:
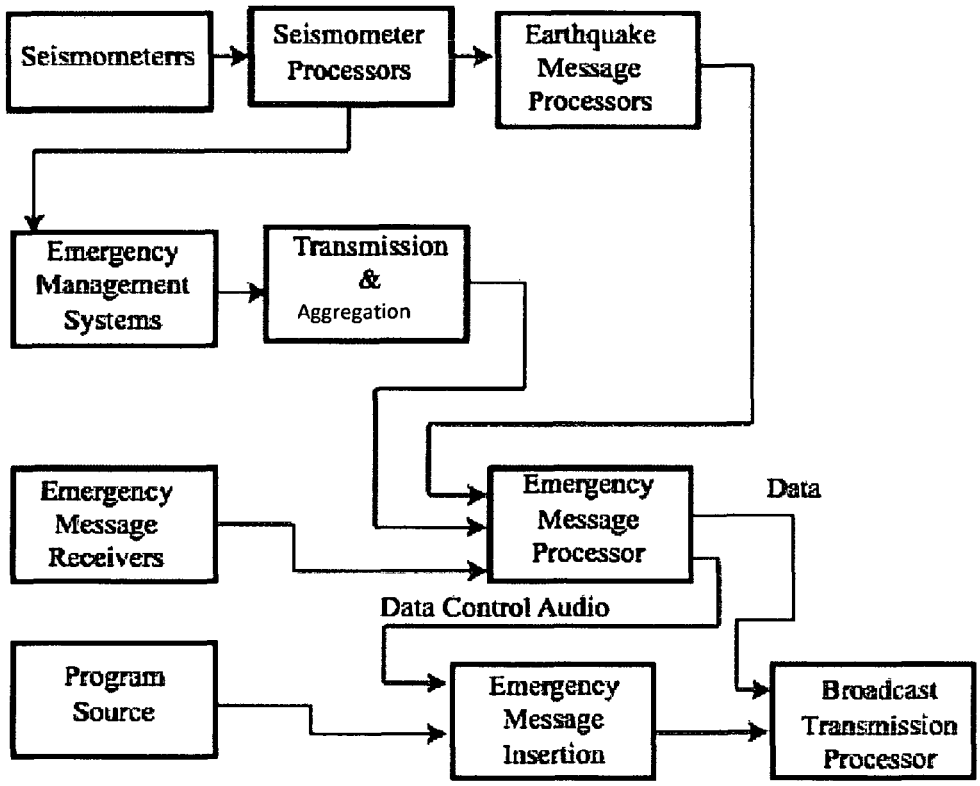
FIG. 11 illustrates a system for broadcasting a rapid earthquake warning.

FIG. 11 illustrates a system for broadcasting a rapid earthquake warning This Earthquake Rapid Alert System based on an improved Emergency Alert System. Note that for rapid earthquake alerts, the method of processing and distribution via an aggregation system is by passed as earthquake alerts are push to the broadcaster over a limited secure network, not by using a polling system. Also that for distribution from the primary broadcasters, other broadcasters may receive via Emergency Message Receivers. While it may appear that alerts could be duplicated, the appropriate use of message IDs and source selection should reduce or eliminate this. Manual means could also do this, as well as provide for false alarm notification.

Significant advantages are realized by practice of the present invention. In its preferred embodiment, the system for transmitting emergency broadcast messages with selectivity to radio, television, computers and smart phones of the present invention comprises:

1) A system designed to work in conjunction with currently implemented EAS systems;
2) said system receiving an EAS signal through antenna, an Internet connection, fiber optic network, Intercom broadcast and the like;
3) said system analyzing the emergency situation and evaluating special category of recipients in a geographic area that are best suited to handle the emergency situation;
4) said system having special codes for each of special category recipient devices;
5) said system encoding EAS messages for a specialized category of recipients, e.g. first responder. Fireman, police, ambulance etc. by stringing along special codes for each special recipient followed by a message that may include video data, audio data and computer data;
6) said system terminating special category messages by a delimiter followed by a generic emergency alert message for the general public, creating an assembled message or by controlling the selection of the Program IDs to be presented, even from a standby mode of reception;
7) digitally broadcasting the assembled encoded emergency alert message to everyone, not just a subset of known recipients;
8) receivers configured for specific audiences, e.g. first responders, are incorporated with a special code for each of the special category devices such that they only receive emergency alert message intended for their individual device and display the EAS message to the user;
9) broadcasting emergency alert messages in this fashion enables legacy devices to receive and present the generic emergency alert message without being burdened by additional information;

whereby the system has special codes for each of responders and special personnel devices and casts the emergency alert message instructions according to their needs thereby providing a coordinated effort to address the emergency while the general public only receives a general emergency alert message if one is directed to the general public.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An emergency alert and message delivery system comprising:

a) one or more receivers for receiving EAS signals from different sources;
b) said system analyzing the emergency signal or message data evaluating a specialized category of recipients or general public in a geographic area and, said each of the specialized category recipients having a special unique code;
c) said system encoding said special code in combination with an EAS message and instructions for each of specialized category of recipients according to needs for the recipient to fulfill an emergency combating function;
d) said system terminating the last message for the specialized category recipient with a delimiter followed by an uncoded public emergency alert message, wherein said system distinguishing specialized category recipients and other private transmission from public transmission by code selection and Program ID usage;
e) digitally retransmitting encoded emergency alert message to everyone including selected recipients or selected retransmission, in said geographic area;
f) said digitally retransmitted encoded emergency alert message received and decoded by specialized category recipient receivers having equivalent specialized unique codes and each of the specialized category of recipients receiving coordinated emergency combating instructions; and
g) said uncoded or publically transmitted portion of said encoded emergency alert message being received by generic basic devices without any special code;

whereby said generic or public emergency alert message is free from instructions while all of said specialized category of recipients receive coordinated instructions to combat an emergency or deliver a message.

2. The emergency alert message system as recited by claim 1, wherein said emergency includes weather related problems, earthquakes, fire emergencies, traffic accidents, road closures, earthquakes and amber alerts.

3. The emergency alert message system as recited as recited by claim 1, wherein said specialized category of recipients includes first responders, fireman, police and ambulance.

4. The emergency alert message system as recited as recited by claim 1, wherein said system broadcasts of data files to computers of specialized category of recipients.

5. The emergency alert message system as recited by claim 1, wherein said system maintains a list of said specialized category of recipients, their specialization and skills, and the special unique codes of recipient receivers.

6. The emergency alert message system as recited as recited by claim 1, wherein said encoded emergency alert message for said specialized category of recipients includes video data, audio data and computer data instructions.

7. The emergency alert message system as recited by claim 1, wherein said retransmitting system receives EAS information through an antenna, a computer network, a fiber optic network Internet, an intercom audio source, a satellite radio or TV network, a telephone line or a cable/fiber TV network said messages may be retransmitted as routing is selected, though not always presented to the public.

8. The emergency alert message system as recited by claim 1, wherein said digital retransmitting of emergency alert messages is delivered through an antenna, coaxial cable or optical fiber.

9. The emergency alert message system as recited by claim 1, wherein said digital retransmitting of emergency alert messages is delivered through the Internet or Local Area Network.

10. The emergency alert message system as recited by claim 1, wherein said specialized category recipient receivers receive an encoded emergency alert message through an antenna, coaxial cable or optical fiber receivers that are not selected to present the alert to the user, but continue to present the regular program content instead of the emergency audio and/or video.

11. The emergency alert message system as recited by claim 1, wherein said specialized category recipient receivers receive an encoded emergency alert message through the Internet, antenna, coaxial cable or optical fiber.

12. The emergency alert message system as recited by claim 1, wherein receivers present emergency messages in the user selected language using audio and/or text displaying the form of closed captioning or Teletext, and the user is optionally provided with a means of message selection.

13. The emergency alert message system as recited by claim 1, wherein receivers present emergency messages of earthquakes or other alerts in a rapid manner.

14. The emergency message system as recited by claim 1, comprising an alternative carrier signal including unused emergency audio channels.

* * * * *